US010107588B2

(12) United States Patent
Rogers

(10) Patent No.: US 10,107,588 B2
(45) Date of Patent: Oct. 23, 2018

(54) VARIABLE POSITION FIREARM HOLSTER AND MEANS OF EFFICIENT WEAPON DRAWING

(71) Applicant: Joseph Rogers, Oakland Park, FL (US)

(72) Inventor: Joseph Rogers, Oakland Park, FL (US)

( * ) Notice: Subject to any disclaimer, the term of this patent is extended or adjusted under 35 U.S.C. 154(b) by 0 days.

(21) Appl. No.: 14/045,220

(22) Filed: Oct. 3, 2013

(65) Prior Publication Data

US 2014/0097216 A1 Apr. 10, 2014

Related U.S. Application Data

(60) Provisional application No. 61/710,086, filed on Oct. 5, 2012.

(51) Int. Cl.
*F41C 33/02* (2006.01)
*F41C 33/04* (2006.01)

(52) U.S. Cl.
CPC ..... *F41C 33/0209* (2013.01); *F41C 33/02* (2013.01); *F41C 33/0227* (2013.01); *F41C 33/0263* (2013.01); *F41C 33/046* (2013.01); *F41C 33/048* (2013.01)

(58) Field of Classification Search
CPC .. F41C 33/0209; F41C 33/02; F41C 33/0227; F41C 33/0263
USPC ..... 224/243, 238, 192, 193
See application file for complete search history.

(56) References Cited

U.S. PATENT DOCUMENTS 944,355 A * 12/1909 Beasley ..... F41C 33/0209 224/191
1,629,700 A * 5/1927 Harter ..... F41C 33/0245 224/193
2,887,689 A * 5/1959 Conlan ..... A41D 27/201 2/252
2,951,622 A * 9/1960 Heim ..... F41C 33/0209 224/192
3,583,612 A * 6/1971 Theodore ..... F41C 33/0227 224/243
3,797,715 A * 3/1974 Scialdone ..... A45F 3/14 224/587
D236,891 S * 9/1975 Welssenburger ..... D3/222
3,938,655 A * 2/1976 Romolt ..... 206/5
4,044,929 A * 8/1977 Caruso ..... F41C 33/0236 224/660

(Continued)

*Primary Examiner* — Nathan J Newhouse
*Assistant Examiner* — Lester L Vanterpool
(74) *Attorney, Agent, or Firm* — Global Intellectual Property Agency, LLC; Jordan Sworen

(57) ABSTRACT

The present invention describes to a new and improved handgun holster that provides concealment of and easy access to the firearm when worn on the torso. The device may be worn at different levels along the torso including that of: deep concealment, inside the waistband, and at the midsection of the torso. The holster includes a protective back that acts to guide the user to proper hand placement when drawing the firearm, as the back plate transforms into a cone shape when the user's thumb is pressed against the protective plate of the holster to remove the firearm and the user's fingers are correctly placed along the opposing side of the weapon grip during the drawing act. The handgun holster further acts as a storage compartment by folding the back plate over the grip of a firearm and wrapping and securing the attachment arms around the holster.

12 Claims, 7 Drawing Sheets

(56) References Cited

U.S. PATENT DOCUMENTS

| | | | | | |
|---|---|---|---|---|---|
| 4,294,385 | A * | 10/1981 | Rogers | F41C 33/0236 | 224/182 |
| 4,398,655 | A * | 8/1983 | Perry | 224/191 | |
| 4,544,089 | A * | 10/1985 | Tabler | F41C 33/0236 | 224/192 |
| 4,966,320 | A * | 10/1990 | DeSantis et al. | 224/665 | |
| 5,054,671 | A * | 10/1991 | Else | F41C 33/0209 | 224/192 |
| 5,209,383 | A * | 5/1993 | Theodore | F41C 33/0227 | 224/193 |
| 5,294,031 | A * | 3/1994 | Volpei et al. | 224/682 | |
| D347,940 | S * | 6/1994 | Linscott | D3/226 | |
| D361,656 | S * | 8/1995 | Fogarty, Jr. | D3/222 | |
| 5,505,355 | A * | 4/1996 | Williams | 224/681 | |
| 5,806,731 | A * | 9/1998 | Mark | F41C 33/0236 | 2/300 |
| 5,829,653 | A * | 11/1998 | Kaiser | 224/577 | |
| 5,909,834 | A * | 6/1999 | Parrott, III | F41C 33/0209 | 224/245 |
| 6,296,164 | B1 * | 10/2001 | Russo | A61F 5/449 | 224/581 |
| 6,698,636 | B2 * | 3/2004 | Angus et al. | 224/660 | |
| 7,258,259 | B1 * | 8/2007 | Owens | 224/193 | |
| D715,538 | S * | 10/2014 | Vertreese | D3/222 | |
| 9,310,162 | B2 * | 4/2016 | Vertreese | F41C 33/043 | |
| 2010/0108728 | A1 * | 5/2010 | Castaneda | F41C 33/0209 | 224/243 |
| 2011/0233243 | A1 * | 9/2011 | Mathys | F41C 33/0209 | 224/243 |
| 2013/0193172 | A1 * | 8/2013 | Damkot et al. | 224/191 | |

* cited by examiner

VARIABLE POSITION FIREARM HOLSTER AND MEANS OF EFFICIENT WEAPON DRAWING

CROSS REFERENCE TO RELATED APPLICATION

This application claims the benefit of U.S. Provisional Application No. 61/710,086 filed on Oct. 5, 2012, entitled "3 Speed Holster." The above identified patent application is herein incorporated by reference in its entirety to provide continuity of disclosure.

BACKGROUND OF THE INVENTION

Field of the Invention

The present invention relates to handgun holsters. More specifically the invention relates to a holster that is wearable at a plurality of positions and further acts to guide the hand of a user to a proper drawing position when the reaching to draw the firearm. The invention is discrete when worn on a user's torso, and thus will be appreciated by individuals with concealed carry firearm permits wishing to carry their gun without attracting notice.

Handgun holsters are designed to hold handguns in an area of the body that is easily accessed by a user. Holsters are convenient for use when placement of the firearm in a pocket of clothing is not considered an option. There are a variety of firearm holsters available for sale that are configured for placement on differing parts of the body that are optimal for the purpose and use of the handgun. Regions of holster placements include that of: outside the waistband (OWB), inside the waistband (IWB), sling holsters, shoulder holsters, belly band holsters, pocket holsters, groin holsters, thigh holsters, ankle holsters, and chest holsters.

The above listed holster types are designed to provide concealment of the firearm or provide quick access from the holster by the wearer. The holsters of the prior art however, lack in the ability to provide both quick access and concealment of the gun. For example, while or groin, belly band, and inside the waistband holsters might be concealed from the view of others, the holsters do not provide quick access to the handgun from its concealed position.

There are several types of firearm holsters that provide gun concealment or quick access to the firearm. However, none of the prior art handgun holsters address the need for a holster that offers both concealment and easy access.

The present invention relates to a new and improved handgun holster designed to offer both the concealment of and easy access to the firearm. The holster can be worn at a several positions along the torso, including that of deep concealment, inside the waistband, and at the midsection (belly band) of the torso. The holster of the present invention comprises a back plate that prevents the firearm from contacting the skin of the wearer and encourages proper hand placement when drawing the firearm by transforming into a cone shape when a hand is inserted into the holster to remove the firearm.

Description of the Prior Art

Devices have been disclosed in the prior art that relate to handgun holsters. These include devices that have been patented and published in patent application publications. These devices generally relate to firearm holsters that offer concealment or ease of access. The following is a list of devices deemed most relevant to the present disclosure, which are herein described for the purposes of highlighting and differentiating the unique aspects of the present invention, and further highlighting the drawbacks existing in the prior art.

Specifically, U.S. Pat. No. 5,054,671 to Else describes a quick-draw holster configured to be worn at the groin level between the waistband of a garment and the waist of the wearer. Although the quick-draw holster of Else is relevant to the present invention, it differs in that it fails to provide concealment of the weapon and further fails to provide a stabilization mechanism for the gun to encourage proper hand placement when drawing the firearm.

U.S. Pat. No. 5,909,834 to Parrott discloses a firearm holster for concealment under and independent of the user's clothing. Although the holster of Parrot is relevant and similar to the present invention, it differs in that it fails to be worn at a plurality of positions along the torso, and further fails to alter its shape to encourage proper hand placement when drawing the firearm.

U.S. Patent Publication No. 2010/0108728 to Castaneda discloses a holster for concealing a handgun. The holster comprises straps to secure to the user's body and further comprises a pocket with an opening at the top for receiving a handgun. When the straps are secured, the tension passes through the top of the pocket and forces the closure of the pocket and the securing of the handgun in the pocket. While the Castaneda publication is relevant and similar to the present invention, it differs in that it fails to provide the ability to be worn at a plurality of positions along the torso, and further fails to alter its shape to encourage proper hand placement when drawing the firearm.

U.S. Patent Publication No. 2011/0233243 to Mathys describes a handgun holster for concealment under a user's clothing. The holster comprises a waterproof fabric duck cloth to prevent absorption of bodily fluids and further comprises nylon webbed straps to prevent sagging over time. Although the Mathys publication is relevant and similar to the present invention, it differs in that it fails to provide the ability to be worn at a plurality of positions along the torso and further fails to alter its shape to encourage proper hand placement when drawing the firearm.

The present invention relates to a firearm holster designed to be worn at one of a plurality of positions along the torso by adjusting the tension of the holster and moving the holster between levels of below the waistband, inside the waistband, and a mid-level carrying position. The holster comprises a seamless firearm compartment and an extended back plate to prevent contact between the weapon and the user's skin. The back plate further acts to guide a user's hand to the proper gripping position on the firearm by shifting into a cone shape around the user's hand when the user contacts the back plate while reaching to draw the weapon.

In view of the aforementioned drawbacks of the prior art, it is shown that the present invention is substantially divergent in design elements from the prior art and consequently it is clear that there is a need in the art for an improvement to existing firearm holster devices. In this regard the instant invention substantially fulfills these needs.

SUMMARY OF THE INVENTION

In view of the foregoing disadvantages inherent in the known types of firearm holsters now present in the prior art, the present invention provides a new multi-level worn holster wherein the same can be utilized for providing convenience for the user when wearing that holster at a plurality of different levels and having a holster that alters its shape to encourage proper hand grip while drawing the firearm is desired.

The variable position firearm holster is designed for those who want the comfort of wearing a holster in public without needing to have the holster exposed. The holster comprises a carrying compartment, attachment arms for securing around the body of the user, and a conforming back plate. The back plate curves into the shape of a cone when pressed by the hand of the user when attempting to draw the firearm from the holster and enables easy removal of the firearm.

The holster further has the ability to be placed at a variety of positions along the torso without needing to be removed from the body. This is accomplished by having elastic attachment arms that are easily adjustable and regain tension when placed on a new portion of the body. This feature is important when transitioning the holster from one section of the body to another in public is necessary.

It is therefore an object of the present invention to provide a new and improved firearm holster device that has all of the advantages of the prior art and none of the disadvantages.

It is another object of the present invention to provide a wearable firearm holster that can be worn in a variety of configurations on a user's torso.

Another object of the present invention is to provide a firearm holster comprising a seamless firearm compartment, thereby avoiding snagging of the holster material when a weapon is drawn.

Another object of the present invention is to provide a firearm holster that has an extended back plate, to protect the wearer's skin from the firearm.

Yet another object of the present invention is to provide a firearm holster that guides the hands into a proper position on the weapon.

Other objects, features and advantages of the present invention will become apparent from the following detailed description taken in conjunction with the accompanying drawings.

BRIEF DESCRIPTIONS OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

FIG. 1 shows a perspective view of the gun holster in a preferred embodiment of the present invention.

FIGS. 2A-E show perspective views of the seamless design of the present invention.

Figure 5A:
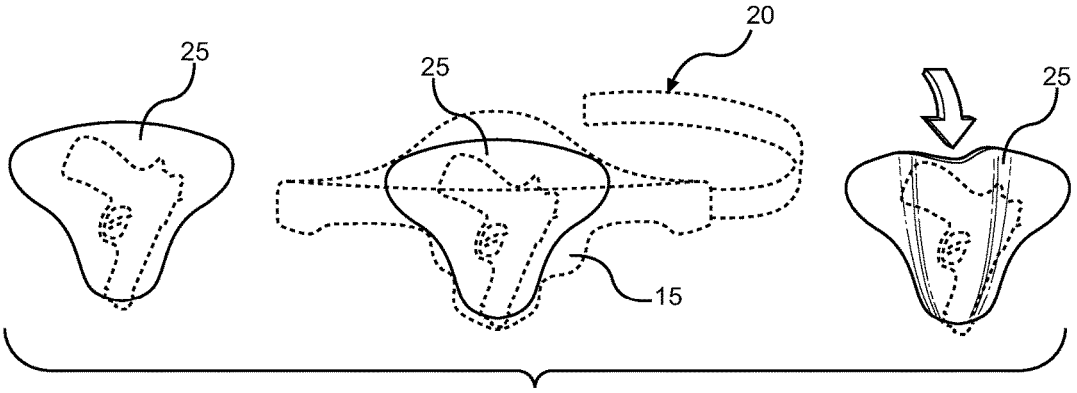
Figure 5B:
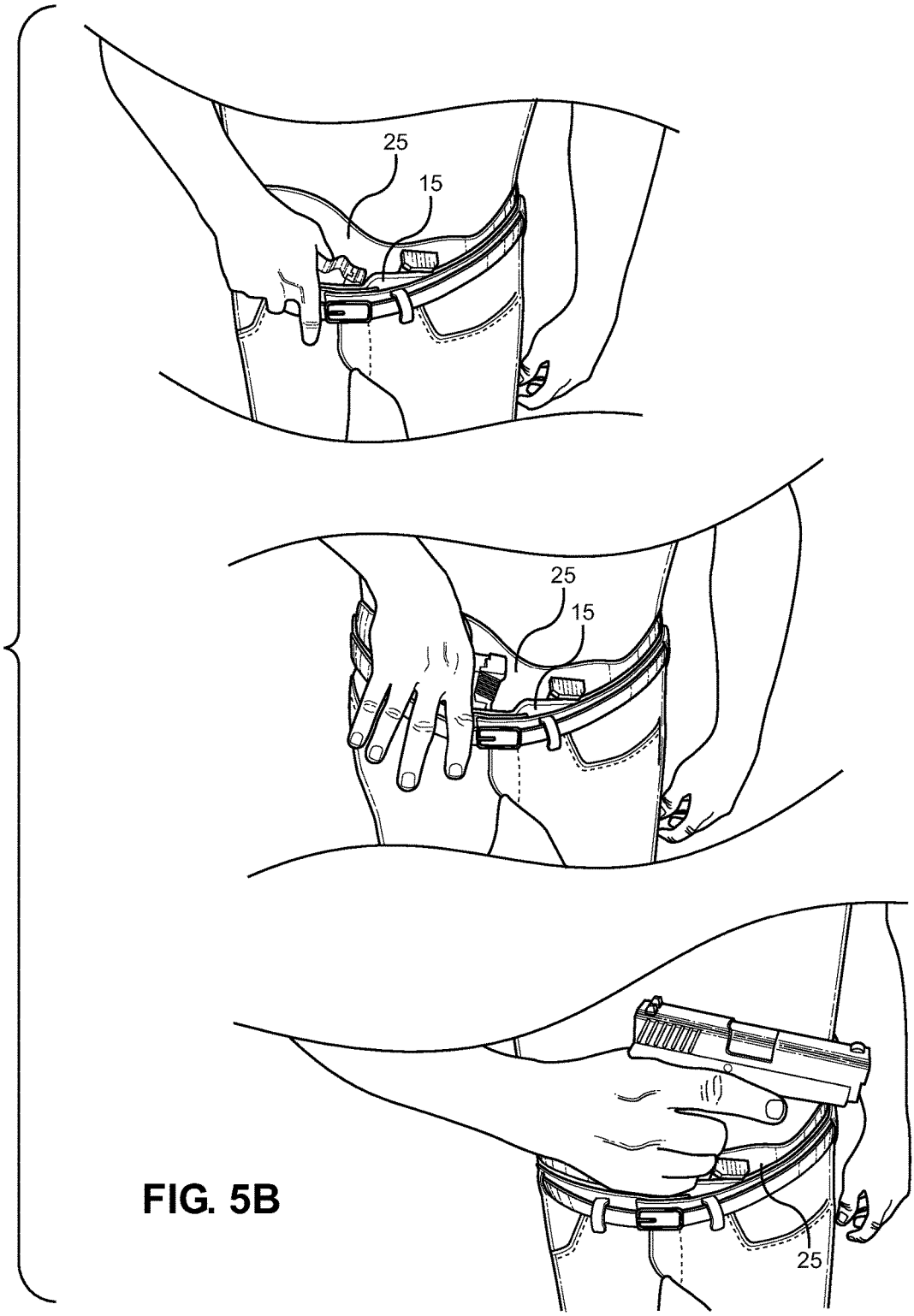

FIGS. 5A-B shows perspective views of the back plate transforming into a cone shape during the drawing of the weapon.

FIGS. 6A-E illustrate the transformation of the holster of the present invention into a more compact form.

DETAILED DESCRIPTION OF THE INVENTION

Reference is made herein to the attached drawings. Like reference numerals are used throughout the drawings to depict like or similar elements of the firearm holster. For the purposes of presenting a brief and clear description of the present invention, the preferred embodiment will be discussed as used for a holster that guides the user's hand into a proper gripping position when drawing a weapon, and further provides a holster that is configured to transition between a plurality of positions along the torso. The figures are intended for representative purposes only and should not be considered to be limiting in any respect.

Figure 1:
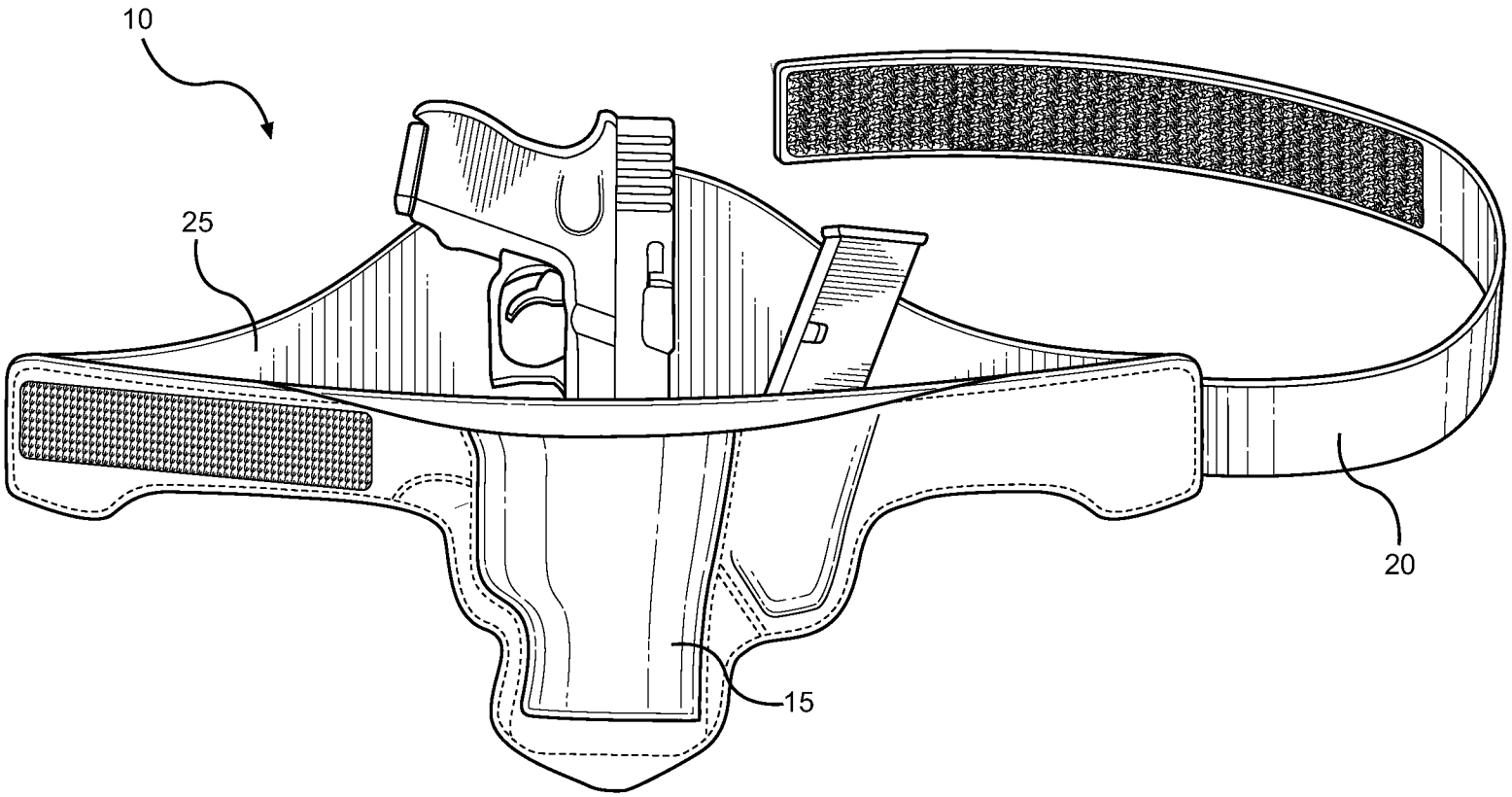

Referring now to FIG. 1, there is shown a perspective view of the firearm holster 10 of the present invention. The holster 10 comprises seamless firearm and accessory compartments 15, attachment arms 20 for wrapping and securing the holster 10 around a user's body, and further includes an extended back plate 25 attached to the firearm compartment 15 and positioned behind the weapon to prevent the weapon from contacting the user's skin.

Figure 2A:
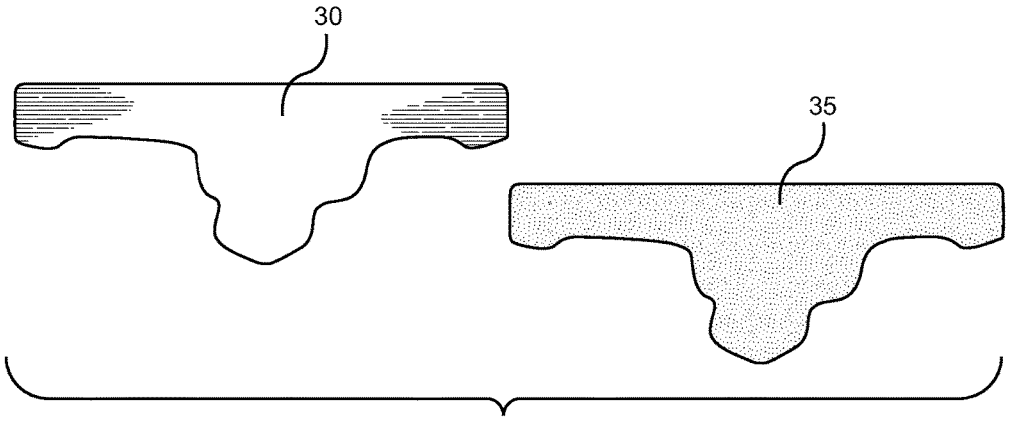
Figure 2B:
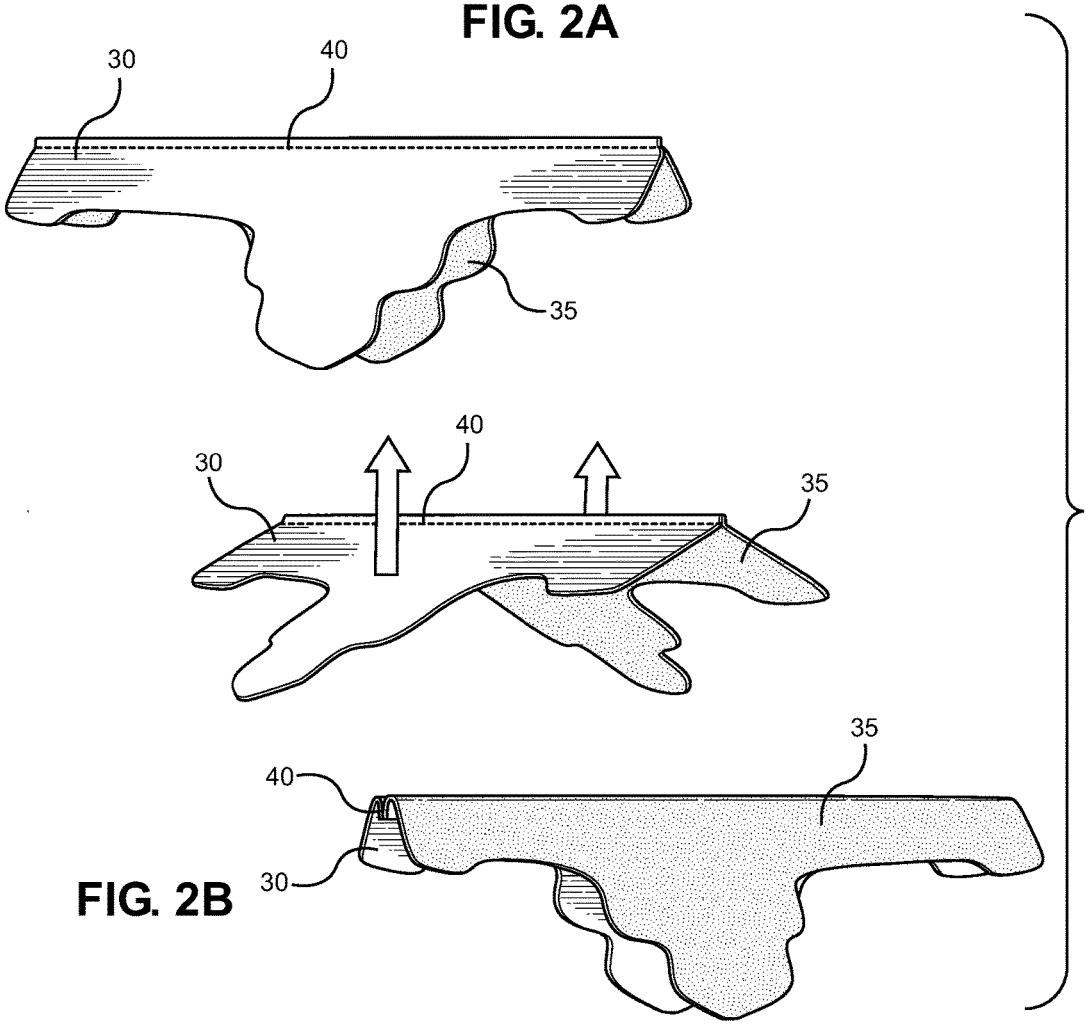
Figure 2C:
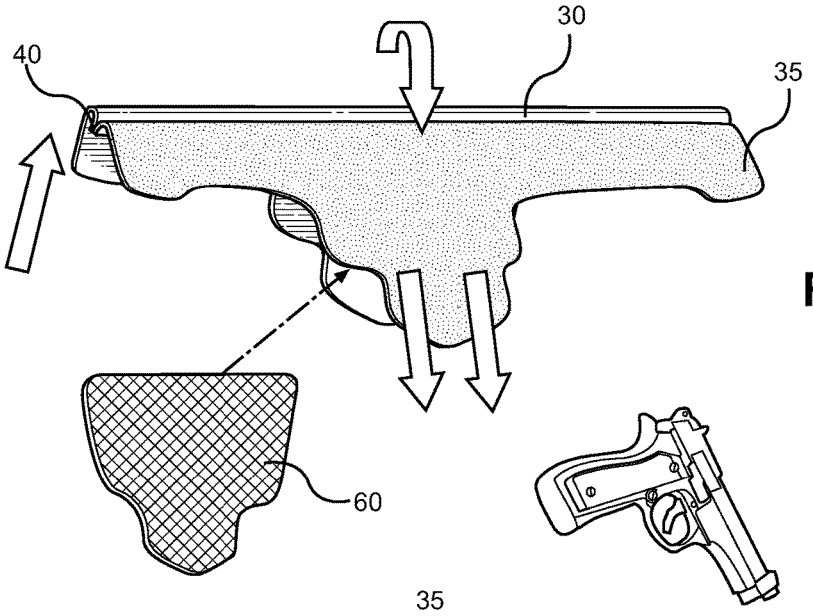
Figure 2D:
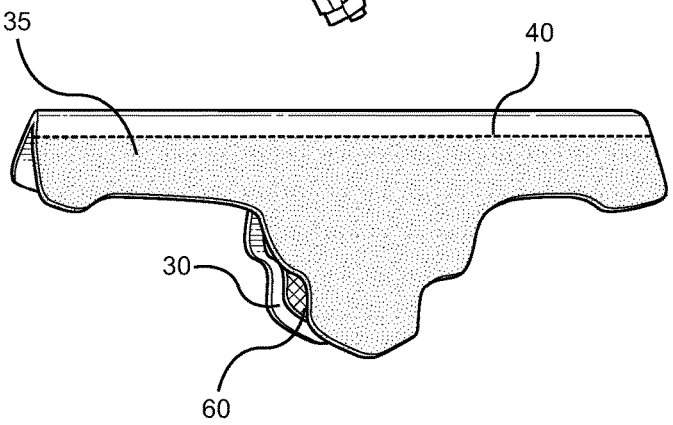
Figure 2E:
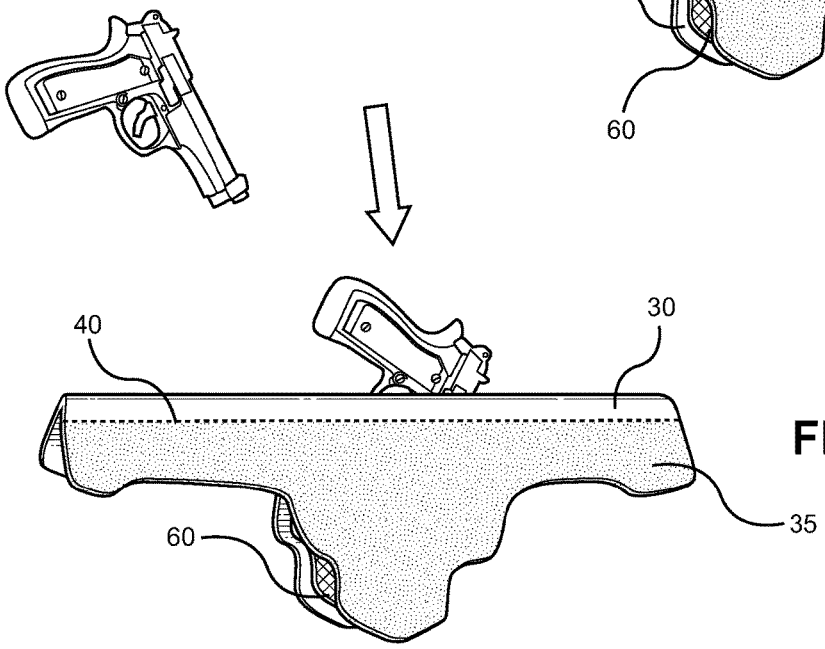

Referring to FIG. 2A-2E, the firearm holster compartments 15 are configured to be seamless in order to prevent the firearm from snagging when inserting or removing from the holster compartment 15. FIGS. 2A and 2B illustrate the first step of the method of constructing the holster compartment. The firearm compartment is constructed by sewing together an inside panel 30 that lies against the weapon to an outside panel 35 that never comes into contact with the firearm. The two pieces are sewn together at an upper portion thereof. The two pieces are then flipped inside out, leaving the seam 40 between the two panels 30, 35. Next, FIG. 2C illustrates the step of creating a seamless interior holster compartment by pulling the exterior panel 35 downward so that the interior panel 30 is shortened to a length less than that of the exterior panel 35. As shown in FIG. 2D, a portion of the interior panel 30 now lies with the exterior panel 35 and will no longer come into contact with the holstered weapon. FIG. 2E illustrates the insertion of the firearm into the holster compartment, wherein the seam 40 is oriented to align with the outside of the holster, and distant from the interior compartment 30 where the firearm lies.

As shown in FIG. 2C, to increase the safety of the holster unit 10, a stiffened panel 60 is positioned between the interior 30 and exterior 35 panels at a point corresponding to the location that covers the area of the trigger guard of a firearm within the firearm holster 10. The panel 60 is preferably plastic and rigid enough to prevent movement of the trigger while in the holster, but remains flexible to not inhibit the mobility of the user. The plastic insert 60 further protects the user from injury by reducing the likelihood of an accidental firing of the weapon while holstered by decreasing the chances that the trigger will be contacted.

Figure 3:
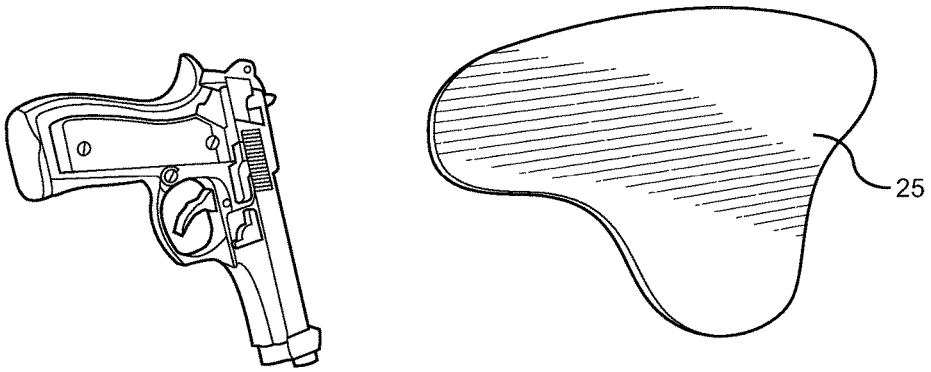
FIG. 3 shows a perspective view of the back plate of the present invention.

Referring to FIG. 3, there is shown a perspective view of the back plate 25 of the firearm holster. The back plate 25 is constructed of a plastic or other suitable material and is covered with a stiff, fabric material that does not restrict the back plate's flexibility. The length of the back plate 25 is configured to be longer than the weapon in order to prevent irritation of the user caused by contact between the grip of the firearm and the skin of the user. As shown in FIG. 1, the back plate 25 is attached to the seamless holster compartment material 15 which forms the pocket that holds the firearm and other gear in the correct place.

Figure 4:
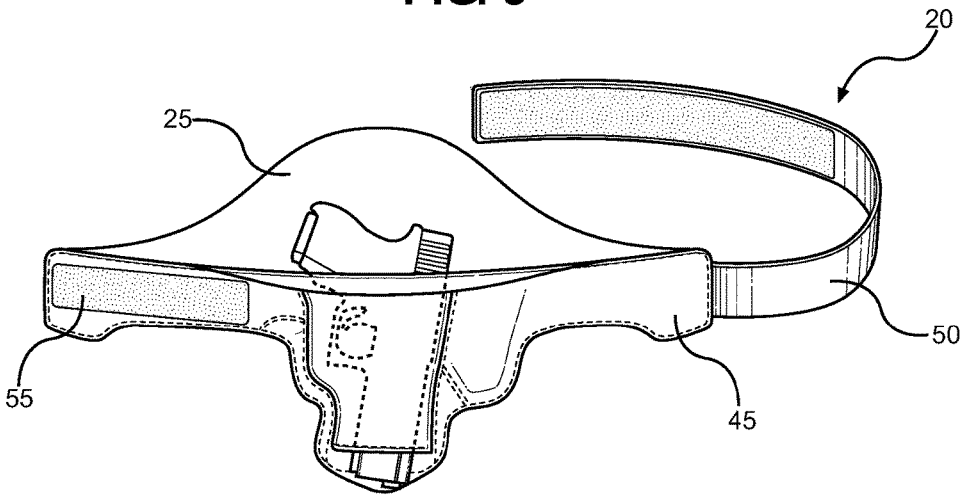
FIG. 4 shows a perspective view of the attachment mechanisms of the present invention.

FIG. 4 shows a perspective view of the firearm holster 10 of the present invention with a focus on its body attachment arms 20. The attachment arms 20 comprise a set of tension tabs 45 that transition into elastic attachment straps 50. The attachment straps 50 are comprised of a thermoplastic elastomer that wraps around the body and are secured to the tension tabs 45 by hook and loop fasteners 55 at an opposite side thereof. The attachment straps 50 enable the firearm holster to be worn at any one of a plurality of locations of the torso, including that of deep concealment below the waistband, inside the waistband (IWB), and a mid-level position.

The holster unit 10 is moved from one position to another by using the tension tabs 45 to release the tension in the unit, wherein the position reassignment does not require the removal of the device, from a user's torso. When the tabs 45 of the attachment arms 20 are lifted slightly by the thumbs of the user, the attachment straps 50 lose a large percentage of their tension around the body and can easily be shifted to from deep concealment, to IWB to the mid-level position. At the deep concealment position the entirety of the holster unit 10 is below the waistline of the user. Deep concealment provides the advantage of wearing the holster unit in public while not showing the gun or holster imprint that comes with wearing a holster 10 at or above the waistline. In this position the tabs 45 hug around the sides of the user when the attachment straps 50 are secured around the wearer, thereby supporting the holster 10 around the user.

The holster transitions between the deep concealment, IWB, and mid-carrying levels by moving the tabs 45 of the elastic attachment arms 20 away from the body. The holster 10 is then moved to the desired level along the torso wherein the tension tabs 45 again resume its tensioned position around the user's body thereof. The changing of positions of the holster is desired because different positions are better suited for different activities. The IWB and mid-level positions provide an advantage over the deep concealment positioning for situations that involve long term sitting and to keep the firearm from resting on the legs of the user it is often more comfortable to keep the holster at a higher position on the body during activities like sitting, driving, and working.

FIG. 5A illustrates a perspective view of the deformation of the back plate 25 that occurs when a user reaches their hand into the holster to remove the firearm. When the user's thumb is inserted within the holster pouch 15 and comes into contact with the back plate 25, the back plate 25 forms a cone shape around the firearm. This cone shape configuration releases the tension that once held the firearm securely in place within the holster compartment 15 and allows for easy removal of the firearm with one hand only. The cone shape configuration of the back plate 25 further acts to guide the user's hands down the holster to a proper gripping position on the weapon, whereby the user's thumb is properly positioned during the gripping and drawing process. Without subsequent repositioning, the user can grasp the backside of the grip with one thumb on one side and all other fingers disposed on the opposite side of the gun and outside of the holster. This allows the user to draw the gun with the user's fingers and thumb in a position as they would be if the user were aiming the gun. Thus, the use can draw and aim without repositioning his or her thumb and fingers after the drawing action. The thumb is positioned correctly and the fingers are ready to pull the trigger immediately upon drawing. Having correct hand positioning on the weapon facilitates reduction in weapon drawing time in critical situations.

Referring now to FIG. 5B, there is shown an illustration of a user removing the weapon when the holster is in a mid-carrying position and the drawing action disclosed above. When the user reaches into the holster to draw the weapon, the pressing of the user's thumb against the back plate 25 such that the plate 25 transitions into a cone shape. The cone-shaped transition causes the previously flattened holster unit to release its pressure on the firearm. The relaxing of the holding pressure on the firearm further assists in the removal of the weapon by facilitating the guiding of the hand to a perfect drawing grip each time. The cone shaped formation further enables the firearm to be drawn with either hand, and positions the fingers outside of the holster and along one side of the weapon grip, while the thumb is advantageously positioned along an opposing side thereof. This eliminates any repositioning of the figures and thumb after drawing and just prior to trigger pull, thereby eliminating this extraneous step. Alternatively, the gun may be returned to the holster by pressing against the back 25 of the holster to form a cone shaped opening. The gun may then be easily placed back within the holster pouch.

Figure 6A:
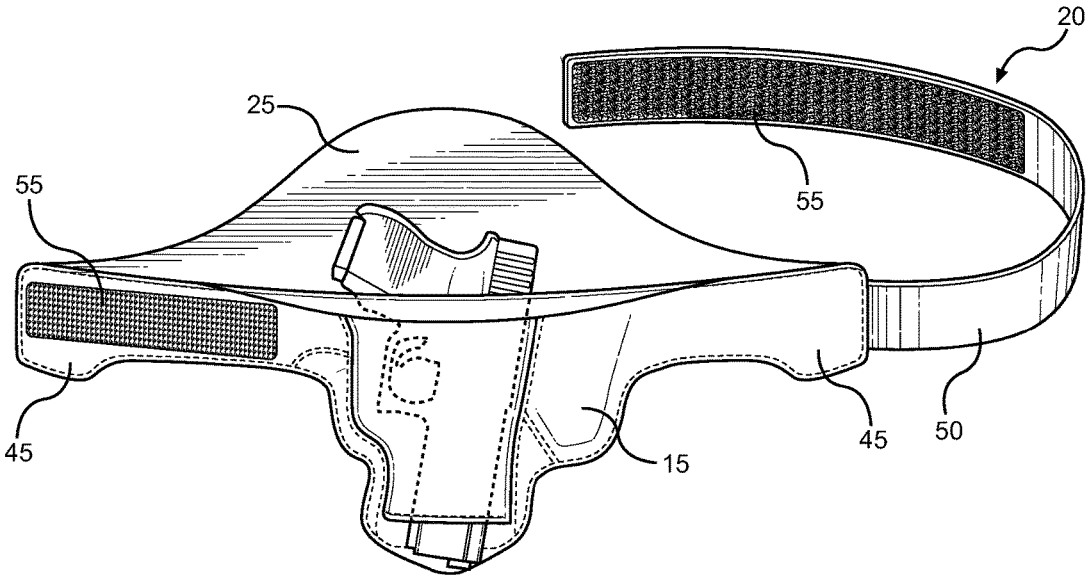
Figure 6B:
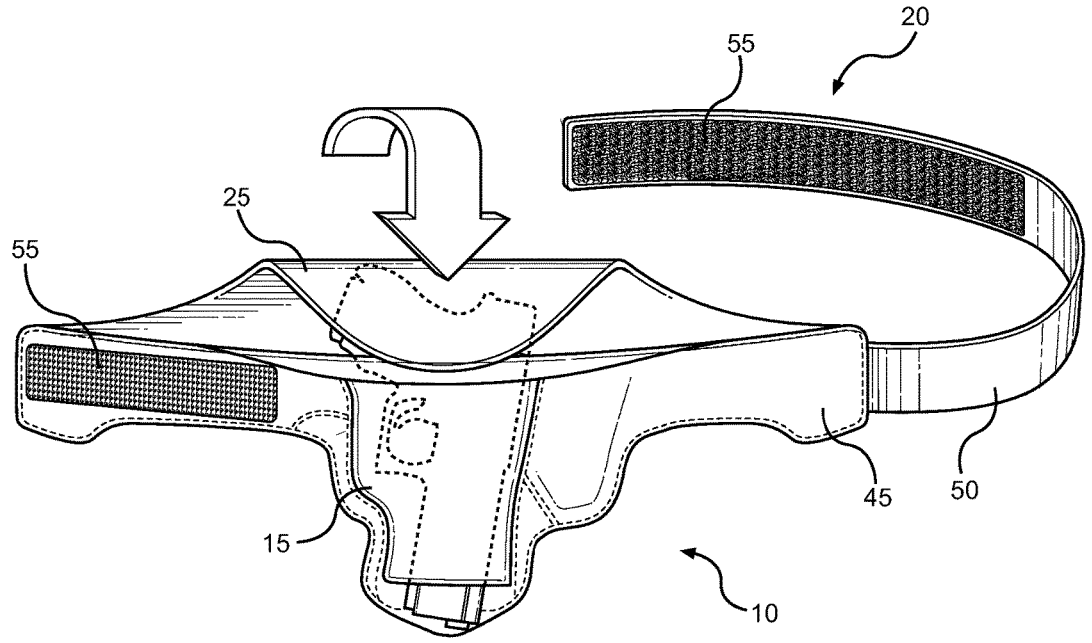
Figure 6C:
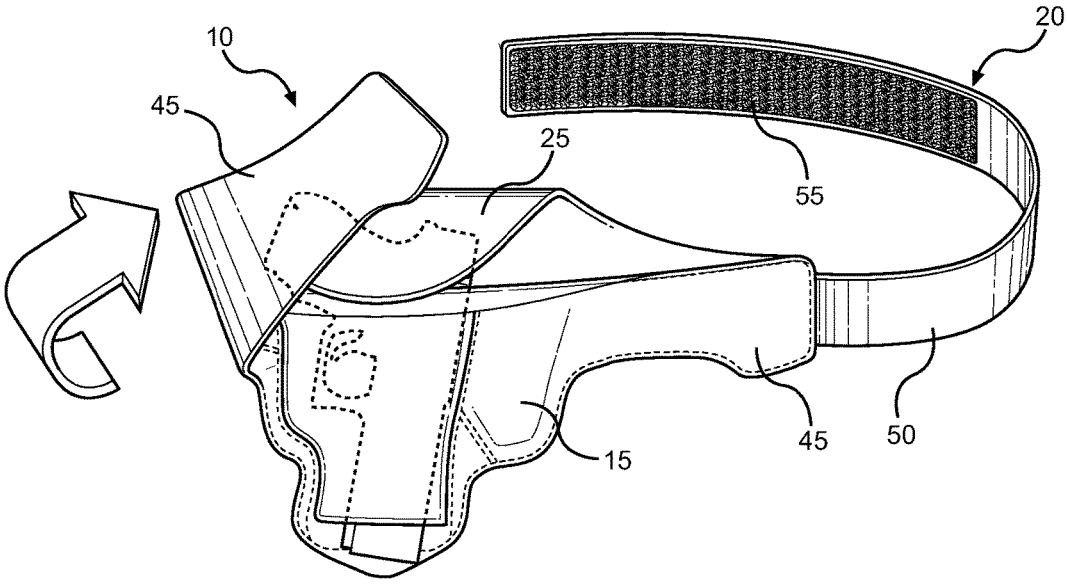
Figure 6D:
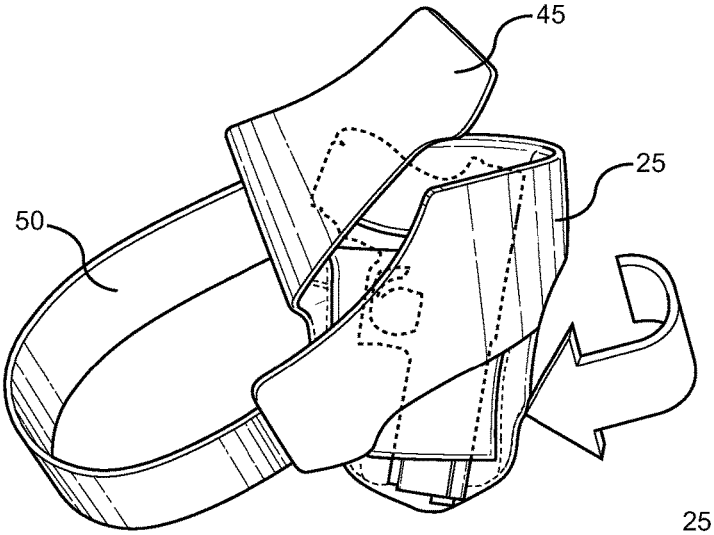
Figure 6E:
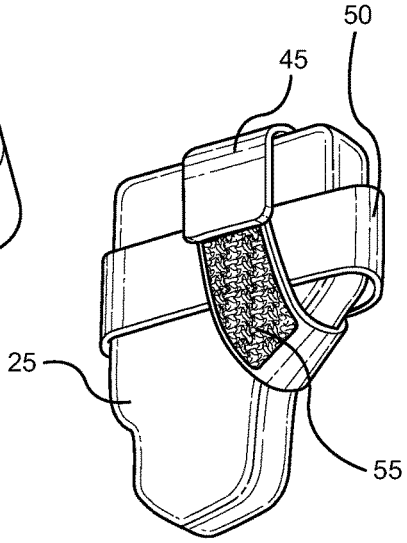

As illustrated in FIGS. 6A-6E, the holster 10 and its back plate 25 of the present invention are sufficiently flexible to be folded into a compact form while having the firearm and its accessories within the firearm compartment 15. FIG. 6B shows the storage configuration is achieved by first securing the weapon within the holster 10 by folding the back plate 25 down over the grip of a handgun. FIG. 6C illustrates where a tension tab 45 on a side of the holster 10 is then folded across the top of the previously folded back plate 25 and the remaining attachment arm 20 and its corresponding attachment strap 50 are folded upward and across the previously folded tension tab 45 in FIG. 6D. FIG. 6E illustrates the completion of the compact form wherein the attachment strap 50 is wrapped around the holster unit 10 and secured at the hook and loop fasteners 55 of the opposing connection tab 45 of the opposing attachment arm 20. This configuration is appropriate for packing the holster away during travel without requiring the firearm and its accessories to be stored in a separate container.

The holster of the present invention is comprised of waterproof materials that prevent slippage of the holster and firearm when the holster is placed against the body. Suitable materials include that of leather and thermoplastics similar to that of NYLON® and KYDEX®. These materials allow for proper and easy draw of the firearm in wet or dry conditions and it is further within the scope of the present invention to modify the size of the firearm compartment 15 and the back plate 25 to accommodate different size handguns.

The present invention provides an improved firearm holster 10 configured to be worn at one of a plurality of locations along the torso: including that of deep concealment, inside the waistband, and a mid-section carrying location. The holster comprises a firearm compartment 15, attachment arms 20 that secure the holster 10 the user's body, and an extended back plate 25 that protects the user's skin from the grip of the firearm. When wrapped around the body, the attachment arms 20 function to secure the firearm within its compartment 15 and relief of the tension of the arms 20 allows the holster 10 to transition between the levels of the torso. The back plate 25 protects the user's skin and additionally conforms into a cone shape when a user's hand is pressed against the plate 25. The cone shape relieves the tension that previously held the firearm in place and enables the user to draw the weapon with one or two hands, and acts to guide the user's hand down the back plate 25 and onto the firearm in a proper gripping position for drawing the weapon. The firearm holster 10, further acts as a storage unit for transportation of the weapon and its accessories by bending the back plate 25 over the firearm compartment 15 and wrapping the attachment arms 20 around the unit 10.

It is therefore submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A firearm holster comprising:

a single front panel distinct from a separate back panel connected via a stitched seam;

wherein the stitched seam is in-turned, forming a seamless exterior surface;

a single back plate connected to the single back panel, the single back plate and the single back panel forming an interior volume configured to receive a firearm therein and configured to hold the firearm in an upright position;

wherein an upper portion of the single back plate is configured to fold over the firearm;

a stiffened panel disposed between the single front panel and the single back panel;

wherein the single back plate is configured to transition between a flattened configuration that is tensioned against the single back panel and a curved configuration via application of force to the single back plate;

wherein the single back plate secures the firearm against the single back panel when the single back plate is in the flattened configuration.

2. The firearm holster of claim 1, wherein the stiffened panel is configured to cover at least a trigger of the firearm.

3. The firearm holster of claim 1, wherein a length of the single front panel is greater than a length of the single back panel.

4. The firearm holster of claim 1, further comprising a strap configured to secure the firearm holster about a user.

5. The firearm holster of claim 1, wherein the curved configuration creates space between the single back plate and the single back panel.

6. The firearm holster of claim 1, wherein the stiffened panel is flat and composed of a material configured to bend.

7. The firearm holster of claim 6, wherein the material is plastic.

8. The firearm holster of claim 1, wherein an interior of the seam is disposed on the exterior surface.

9. The firearm holster of claim 3, wherein an interior of the seam is disposed on the exterior surface.

10. The firearm holster of claim 1, wherein the single back plate comprises an interior material composed of plastic and an exterior material composed of fabric.

11. The firearm holster of claim 1, wherein the curved configuration extends a vertical length the single back plate.

12. The firearm holster of claim 1, wherein the curved configuration tapers toward a lower end of the firearm holster such that a thumb of a user is guided into a firing position around the firearm while the thumb is disposed in the interior volume of the firearm holster.

* * * * *